US010667633B2

(12) United States Patent
Clearman et al.

(10) Patent No.: US 10,667,633 B2
(45) Date of Patent: Jun. 2, 2020

(54) INTEGRATED GROUND-AFFIXING SYSTEMS, DEVICES, AND METHODS FOR GROUND COVERS

(71) Applicant: Clearman Labs LLC, Boulder, CO (US)

(72) Inventors: Christopher Aaron Clearman, Boulder, CO (US); Jaime Lynn Caso, Boulder, CO (US)

(73) Assignee: Clearman Labs LLC, Boulder, CO (US)

( * ) Notice: Subject to any disclaimer, the term of this patent is extended or adjusted under 35 U.S.C. 154(b) by 57 days.

(21) Appl. No.: 15/802,761

(22) Filed: Nov. 3, 2017

(65) Prior Publication Data

US 2018/0128007 A1 May 10, 2018

Related U.S. Application Data

(60) Provisional application No. 62/496,988, filed on Nov. 4, 2016.

(51) Int. Cl.

| | |
|---|---|
| ***A47G 9/06*** | (2006.01) |
| ***E04H 15/62*** | (2006.01) |
| ***E04H 15/56*** | (2006.01) |

(52) U.S. Cl.

CPC ..... *A47G 9/062* (2013.01); *E04H 15/56* (2013.01); *E04H 15/62* (2013.01)

(58) Field of Classification Search

CPC ..... A47G 9/062; E04H 15/56; E04H 16/62

See application file for complete search history.

(56) References Cited

U.S. PATENT DOCUMENTS 1,871,570 A * 8/1932 Weber ..... B63B 19/12 52/3
2,898,609 A * 8/1959 Storie ..... A45C 3/10 5/419
2,907,057 A * 10/1959 Specht ..... E04H 15/62 5/417

(Continued)

FOREIGN PATENT DOCUMENTS

FR 2678154 A1 * 12/1992 ..... A45C 3/10

OTHER PUBLICATIONS

Parasheet Quick-Dry Beach Sheet. The Grommet. Available at https://www.thegrommet.com/parasheet-quickdry-beach-sheet. Last retrieved Aug. 1, 2019.

*Primary Examiner* — Eret C McNichols
(74) *Attorney, Agent, or Firm* — Wilson Patent Law, LLC

(57) ABSTRACT

Methods, systems, and device for affixing a ground cover to the ground are provided in accordance with various embodiments. For example, some embodiments include a system that may include a ground cover and one or more stakes coupled with the ground cover. In some embodiments, the one or more stakes are coupled with the ground cover utilizing one or more tethers. The one or more tethers may include one or more elastic materials. In some embodiments, the one or more elastic materials include one or more flat elastic bands. In some embodiments, the one or more elastic materials include one or more round elastic chords. Some embodiments of the system include one or more storage components coupled with the ground cover; each of the one or more storage components may be configured to stow one of the one or more stakes.

17 Claims, 12 Drawing Sheets

(56) References Cited

U.S. PATENT DOCUMENTS 3,226,737 A * 1/1966 Rote ..... A47G 9/062 5/417
3,237,904 A * 3/1966 Abruzese ..... E04H 15/62 248/508
5,082,707 A * 1/1992 Fazio ..... A47G 9/062 428/43
5,141,200 A * 8/1992 Sherman ..... A47G 9/062 248/500
5,406,659 A * 4/1995 Camp ..... A47G 9/062 5/417
5,443,880 A * 8/1995 Wike ..... A47K 10/02 2/253
5,499,411 A * 3/1996 Wong ..... A47G 9/062 5/417
6,192,536 B1 * 2/2001 Connors ..... A47G 9/062 383/4
6,226,813 B1 5/2001 Wilburn
6,275,993 B1 8/2001 McCarley
6,631,527 B2 * 10/2003 Hyduk ..... A45F 3/44 135/118
6,845,518 B1 1/2005 Boesen
D539,069 S * 3/2007 Hamburg ..... E04H 15/62 D6/608
8,122,538 B2 * 2/2012 McBrearty ..... A47G 9/062 297/219.1
8,146,183 B2 * 4/2012 Nirmel ..... E04H 15/62 135/118
8,327,476 B1 * 12/2012 Paratore ..... A47G 9/062 5/417
8,959,679 B1 * 2/2015 Everds ..... A47G 9/062 206/38
9,279,270 B1 * 3/2016 Treister ..... A61K 33/24
9,402,489 B2 8/2016 Clearman
2005/0005355 A1 * 1/2005 Marks ..... A47G 9/062 5/417
2008/0127414 A1 6/2008 Allen
2012/0284917 A1 * 11/2012 Nirmel ..... A47G 9/0238 5/417
2015/0020310 A1 * 1/2015 Guillaume ..... A47G 9/062 5/417

* cited by examiner

INTEGRATED GROUND-AFFIXING SYSTEMS, DEVICES, AND METHODS FOR GROUND COVERS

CROSS-REFERENCES TO RELATED APPLICATIONS

This application is a non-provisional patent application claiming priority benefit of U.S. provisional patent application Ser. No. 62/496,988 filed on Nov. 4, 2016 and entitled "INTEGRATED GROUND-AFFIXING MECHANISM FOR RECREATIONAL BLANKETS," the entire disclosure of which is herein incorporated by reference for all purposes.

BACKGROUND

A variety of blankets or ground covers may generally be directed towards leisure and recreational uses. These products may come in several fabrics and sizes, but the uses are generally similar. Uses may include, but are not limited to, lying down, picnicking, and/or keeping oneself and possessions dry and free of dirt or other particulate ground matter while enjoying the outdoors. Some of these ground covers may pack into carrying pouches for convenience. In some cases, these ground covers may be made of light-weight materials.

There may be a need for other tools and techniques for ensuring that these ground covers may remain in place despite wind or other disturbing forces.

SUMMARY

Methods, systems, and device for affixing a ground cover to the ground are provided in accordance with various embodiments. For example, some embodiments include a system that may include a ground cover and one or more stakes coupled with the ground cover. In some embodiments, the one or more stakes are coupled with the ground cover utilizing one or more tethers. The one or more tethers may include one or more elastic materials. In some embodiments, the one or more elastic materials include one or more flat elastic bands. In some embodiments, the one or more elastic materials include one or more round elastic chords.

Some embodiments of the system include one or more storage components coupled with the ground cover; each of the one or more storage components may be configured to stow one of the one or more stakes. In some embodiments, each of the one or more storage components includes: a first layer of material coupled with the ground cover; and/or an opening through the first layer of material to allow one of the one or more stakes to be stored between the first layer of material and a portion of the ground cover. In some embodiments, each of the one or more storage components includes a second layer of material coupled with the ground cover such that one of the respective one or more stakes is stored between the first layer of material and the second layer of material.

In some embodiments, the first layer of material of each respective storage component includes at least one free edge; the first layer of material and a portion of the ground cover may form a pocket. In some embodiments, each of the one or more stakes is stored in the pocket of a respective one of the one or more storage components. In some embodiments, each pocket is configured to receive a weighting material separate from the one or more stakes.

In some embodiments, the second layer of material of each respective storage component includes at least one free edge; the first layer of material, the second layer of material, and/or a portion of the ground cover may form a pocket.

Some embodiments of the system may include one or more catches configured to hinder the one or more stakes from slipping out from a respective storage component. In some embodiments, the one or more catches include at least a loop or a protrusion formed as part of the one or more tethers. In some embodiments, the one or more catches include a protrusion formed as part of each respective stake or attached with a respective stake. In some embodiments, the one or more catches are positioned with respect to each respective stake such that each catch catches underneath a portion of the first layer of material of a respective storage component proximal to the opening through the first layer of material.

In some embodiments of the system, the one or more stakes include four stakes. In some embodiments, each respective storage component is configured such that a central axis of each of the four stakes is substantially parallel with the central axes of the other stakes when the four stakes are stowed in respective storage components. In some embodiments, each stake includes a flat material. In some embodiments, each stake includes a metallic material.

Some embodiments include a method where a ground cover may be affixed to the ground utilizing one or more stakes; the one or more stakes are coupled with the ground cover utilizing one or more tethers.

Some embodiments include a method where one or more stakes may be removed from one or more storage components where the one or more storage components are coupled with a ground cover. The ground cover may be affixed to a ground utilizing the one or more stakes, where the one or more stakes are coupled with the ground cover utilizing one or more tethers. In some embodiments, the one or more tethers may be stretched in order to keep the ground cover stretched tightly across the ground. For example, the one or more tethers may include an elastic material. The elastic material may include a flat elastic band in some embodiments; some embodiments may utilize a round elastic chord.

Some embodiments include methods, systems, and/or devices as described in the specification and/or shown in the figures.

The foregoing has outlined rather broadly the features and technical advantages of embodiments according to the disclosure in order that the detailed description that follows may be better understood. Additional features and advantages will be described hereinafter. The conception and specific embodiments disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of different embodiments may be realized by reference to the following drawings. In the appended figures, similar components or features may have the same reference label.

Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1A:
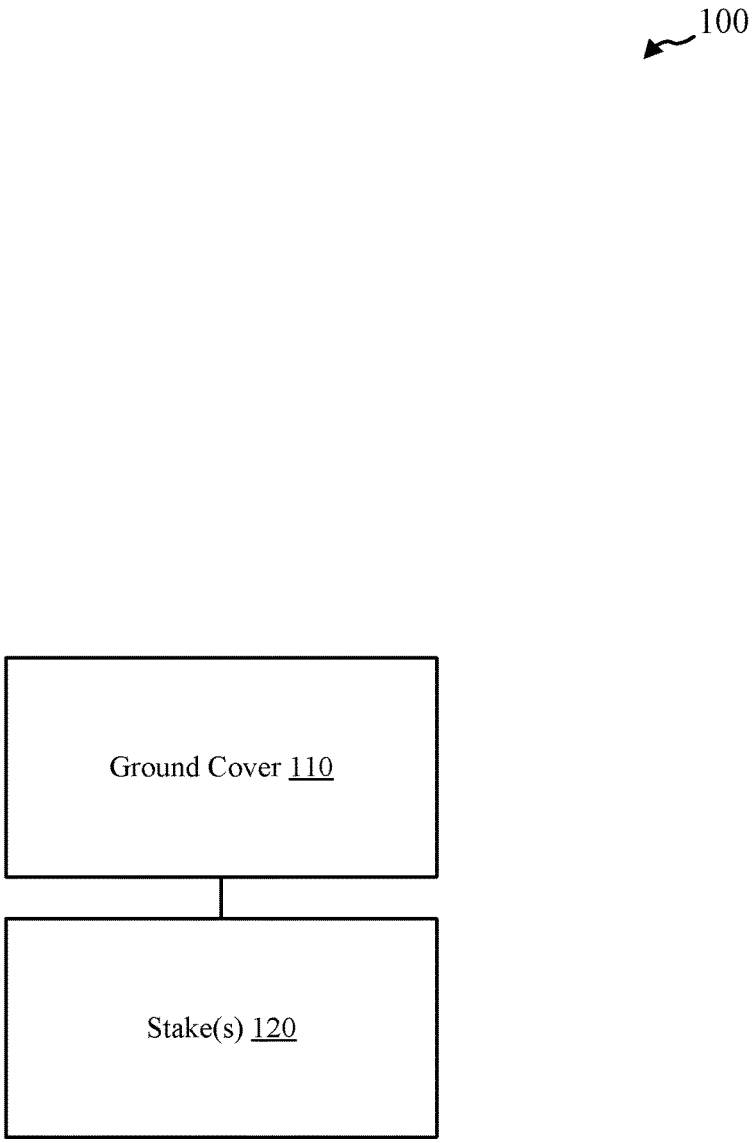
FIG. 1A shows a system in accordance with various embodiments.

This description provides embodiments, and is not intended to limit the scope, applicability or configuration of the disclosure. Rather, the ensuing description will provide those skilled in the art with an enabling description for implementing embodiments of the disclosure. Various changes may be made in the function and arrangement of elements.

Thus, various embodiments may omit, substitute, or add various procedures or components as appropriate. For instance, it should be appreciated that the methods may be performed in an order different than that described, and that various stages may be added, omitted or combined. Also, aspects and elements described with respect to certain embodiments may be combined in various other embodiments. It should also be appreciated that the following systems, devices, and methods may individually or collectively be components of a larger system, wherein other procedures may take precedence over or otherwise modify their application.

Methods, systems, and device are provided in accordance with various embodiments that may provide integrated ground-affixing mechanisms for ground covers, such as recreational ground covers or other blankets. Some embodiments may be referred to as ground cover tethering systems. Some embodiments are directed to an integrated mechanism for picnic and recreational blankets and other ground covers for affixing the ground cover to the ground below it. Some embodiments may help ensure that these ground covers may remain in place despite wind or other disturbing forces. Some embodiments may integrate these mechanisms into the construction of these blankets and ground covers for ease and convenience.

For example, in some embodiments, there may be a stake or other spike-like structure attached or tethered to the ground cover that can be driven into the ground to secure the ground cover. These stakes may be constructed of metal, plastic, wood, composite, and/or any other rigid material. In some embodiments, the stakes are attached to the ground cover via elastic, string, rope, and/or other flexible material. In some embodiments, the stakes may be referred to as ground stakes and/or tethered ground stakes.

In some embodiments, the stakes may pack away into a storage component on the ground cover for storage while not in use. This compartment may be a fabric pouch, plastic, and/or other rigid mold, elastomeric case, and/or any other composition. When the stakes are in their storage component, they may also act as a weighted corner or edge for the ground cover.

The one or more stakes may be tethered to the ground cover with a string, rope, strap, or any flexible or elastic material. In some embodiments, the stake is tethered to the ground cover with a flat elastic band. The elasticity of the band may function to keep the ground cover stretched tightly across the ground even when acted upon by external forces including, but not limited to, wind and/or ground cover users. It also may make the stakes less likely to be pulled from the ground because the elastic bands may introduce some flexibility into the ground cover tethering system.

There may be any number of stakes used including embodiments that utilize only a single stake. Some embodiments utilize four stakes with one stake placed at each corner of a rectangular or square ground cover.

In some embodiments, the attachment of the stake to the ground cover includes a loop or other protrusion that may prevent the stake from slipping out of its storage component unbeknownst to the user. This loop may be constructed from the stake's tether material or can be formed on or affixed to the stake itself. There may be other embodiments that prevent the stake from slipping from its compartment when not in use.

In some embodiments, the corners or sides may have flaps constructed so that they can be filled with sand, gravel, dirt, or other material in order to weight the corners or edges of the ground cover against wind or other disturbances. These flaps may be located on the top or the bottom surface of the ground cover, and on any edge or corner of the ground cover, though a flap may also be attached to other portions of the ground cover. There may be any number of flaps present, including the possibility of only a single flap; some embodiments include four flaps. These flaps can be of any size or shape including triangular or square. The flaps may generally have at least one edge attached to the main body of the ground cover and one open edge to allow filling with loose material. These flaps may be intended to form a pocket that may accept loose material to increase the weight of the ground cover. In some embodiments, the flaps are triangular and are attached to the blanket along two edges. This may leave a third edge open to receive loose material as added weight. For flaps with more than three sides, one or more edges may be attached to the blanket and one or more edges may not be attached to create a pocket or flap.

These flaps may be constructed from a single layer of material or with multiple overlapping layers of material, such as fabric layers. There is generally no limit to the number of layers that can be used to construct the flap. In some embodiments, the corner flap is constructed with two overlapping layers of fabric. A storage component may be created between the two overlapping layers of fabric that may be used as a pocket for storage. This pocket could be used to store any item of appropriate size. In some embodiments, the storage component is used to store the tethered stakes.

In some embodiments, the stakes may or may not be stored between the two layers of material that create the flap. There may be an opening in one of the layers used to create the flap so that the stake or other items may be placed between the two or more layers for storage; the flap may be constructed from a single layer of fabric, though additional layers may be utilized in some embodiments. The stake may also be stored entirely beneath the assembly that creates the flap. In this embodiment, the stake may be stored in the pocket that may be intended to receive loose material to increase overall blanket weight. The stake may also be stored outside of the corner flap assembly entirely. In some embodiments, the stake may not even be stored within or beneath the corner flap assembly.

When not deployed, these stakes may function as additional weights to keep the ground cover in place against disturbances. Ground covers, such as recreational blankets, may have weights added to the corners or edges to prevent movement against disturbances such as wind or user movement. In some embodiments, the stakes are stored between the multiple layers of material used to construct the flap assembly. These stakes may generally be constructed of a relatively dense material so that their weight may be utilized to protect against disturbances. In some embodiments, the stakes act as corner weights when they are in the storage state.

The ground cover may be made from a variety of materials. In general, the ground cover may include a material that may be capable of being folded and subsequently unfolded while maintaining its structural integrity. Some embodiments may include woven and nonwoven fabrics, and/or rubber, plastic, and/or fibrous sheet material. Depending on the intended use of the ground cover, the flexible material may be air-permeable or air-impermeable; some embodiments may be waterproof or water-resistant. The flexible material may include one or more coatings to modify its properties, for example a polymeric waterproofing coating. In general, thicker materials may provide greater isolation from the ground surface, while thinner materials may be easier to fold.

Turning now to FIG. 1A, a system 100 is provided in accordance with various embodiments. System 100 may be referred to as an integrated ground-affixing system for ground covers. System 100 may include a ground cover 110. System 100 may also include one or more stakes 120 coupled with the ground cover 110. In some embodiments, the one or more stakes 120 are coupled with the ground cover 110 utilizing one or more tethers. The one or more tethers may include one or more elastic materials. In some embodiments, the one or more elastic materials include one or more flat elastic bands. In some embodiments, the one or more elastic materials include one or more round elastic chords. Other materials may be utilized for the one or more tethers such as string, rope, strap, or other flexible material. The one or more stakes 120 may be constructed of metal, plastic, wood, composite, or any other rigid material. In some embodiments, the one or more stakes 120 may include a flat, metallic construction.

Some embodiments of the system 100 include one or more storage components coupled with the ground cover 110; each of the one or more storage components may be configured to stow one of the one or more stakes 120. In some embodiments, each of the one or more storage components includes: a first layer of material coupled with the ground cover; and/or an opening through the first layer of material to allow one of the one or more stakes 120 to be stored between the first layer of material and a portion of the ground cover. In some embodiments, each of the one or more storage components includes a second layer of material coupled with the ground cover such that the one of the one or more stakes 120 is stored between the first layer of material and the second layer of material.

In some embodiments, the first layer of material of each respective storage component includes at least one free edge; the first layer of material and a portion of the ground cover 110 may form a pocket. In some embodiments, each of the one or more stakes 120 is stored in the pocket of a respective one of the one or more storage components. In some embodiments, each pocket is configured to receive a weighting material separate from the one or more stakes 120.

In some embodiments, the second layer of material of each respective storage component includes at least one free edge; the first layer of material, the second layer of material, and/or a portion of the ground cover 110 may form a pocket.

Some embodiments of the system 100 include one or more catches configured to hinder the one or more stakes 120 from slipping out from a respective storage component. In some embodiments, the one or more catches include at least a loop or a protrusion formed as part of the one or more tethers. In some embodiments, the one or more catches include a protrusion formed as part of each respective stake 120 or attached with a respective stake 120. In some embodiments, the one or more catches are positioned with respect to each respective stake 120 such that each catch catches underneath a portion of the first layer of material of a respective storage component proximal to the opening through the first layer of material.

In some embodiments of the system 100, the one or more stakes 120 include four stakes. In some embodiments, each respective storage component is configured such that a central axis of each of the four stakes 120 is substantially parallel with the central axes of the other stakes 120 when the four stakes are stowed in respective storage components. In some embodiments, each stake 120 includes a flat material. In some embodiments, each stake 120 includes a metallic material.

Figure 1B:
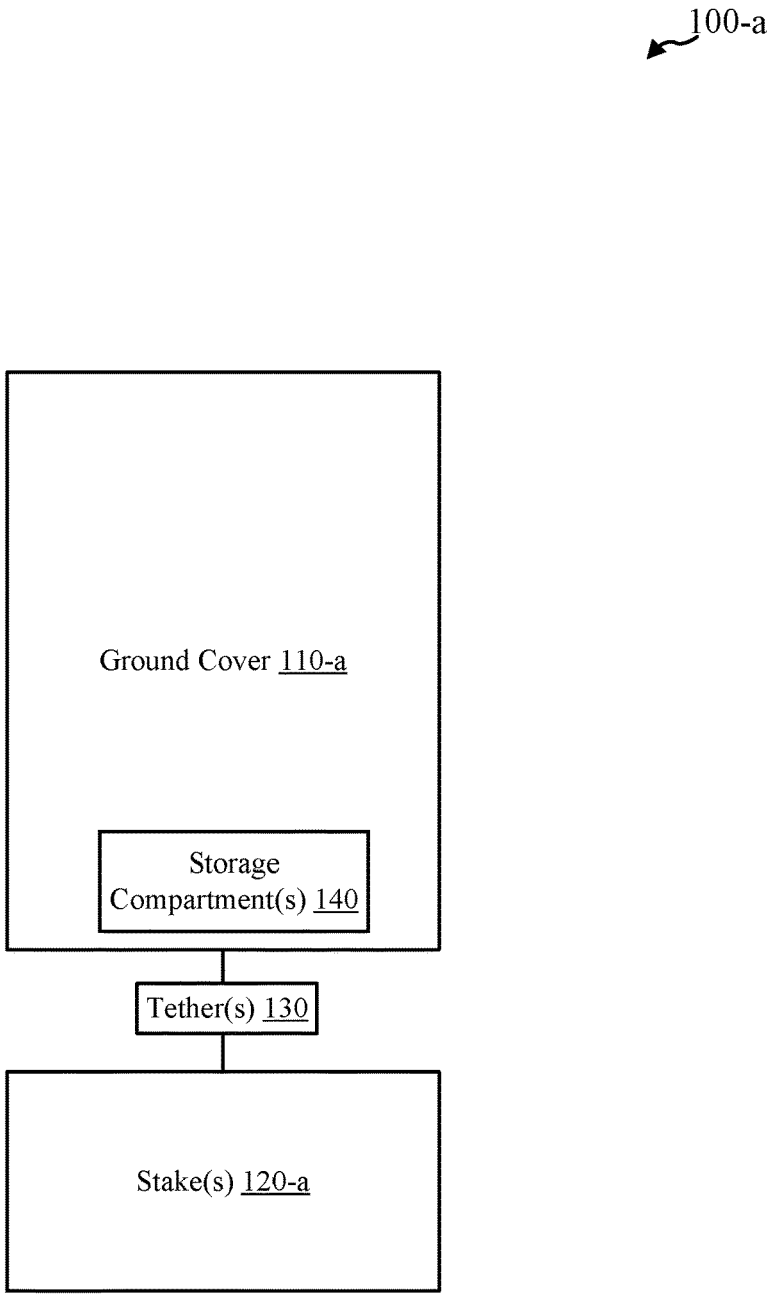
FIG. 1B shows a system in accordance with various embodiments.

FIG. 1B shows a system 100-*a* provided in accordance with various embodiments. System 100-*a* may be an example of system 100 of FIG. 1A. System 100 may be referred to as an integrated ground-affixing system for ground covers.

System 100-*a* may include a ground cover 110-*a*. System 100-*a* may also include one or more stakes 120-*a* coupled with the ground cover 110-*a*. In some embodiments, the one or more stakes 120-*a* are coupled with the ground cover 110-*a* utilizing one or more tethers 130. The one or more stakes 120-*a*, which may include other spike-like structures, may be attached or tethered to the ground cover 110-*a* utilizing the one or more tethers 130 such that the one or more stakes 120-*a* may be driven into the ground to secure the ground cover 110-*a*.

The one or more stakes 120-*a* may be constructed of metal, plastic, wood, composite, or any other rigid material. Some embodiments may utilize one or more stakes 120-*a* fabricated from a flat material that may include a metallic material. In some embodiments, the one or more tethers 130 include one or more elastic materials; the one or more elastic materials include one or more flat elastic bands. In some embodiments, the one or more elastic materials include one or more round elastic chords. Other materials may be utilized for the one or more tethers such as string, rope, strap, or other flexible material. The one or more stakes 120-*a* may be constructed of metal, plastic, wood, composite, or any other rigid material. In some embodiments, the one or more stakes 120-*a* may include a flat, metallic construction.

In some embodiments, the elasticity of the one or more tethers 130 may function to keep the ground cover 110-*a* stretched tightly across the ground even when acted upon by external forces including but not limited to wind and ground cover users. It also may make the one or more stakes 120-*a* less likely to be pulled from the ground since the elastic material, such as flat elastic bands or round elastic chords, may have introduced some flexibility into the ground cover tethering system.

There may be any number of stakes 120-*a* used; some embodiments utilize only a single stake 120-*a*. Some embodiment utilizes four stakes 120-*a*, with one stake placed at each corner of a rectangular or square ground cover 110-*a*.

Some embodiments of the system 100-*a* include one or more storage components 140 coupled with the ground cover 110-*a*; each of the one or more storage components 140 may be configured to stow one of the one or more stakes 120-*a*. The one or more storage components may be referred to as storage compartments. In some embodiments, each of the one or more storage components 140 includes: a first layer of material coupled with the ground cover 110-*a*; and/or an opening through the first layer of material to allow one of the one or more stakes 120-*a* to be stored between the first layer of material and a portion of the ground cover 110-*a*. In some embodiments, each of the one or more storage components 140 includes a second layer of material coupled with the ground cover 110-*a* such that the one of the one or more stakes 120-*a* is stored between the first layer of material and the second layer of material.

For example, each stake 120-*a* may pack away into a respective storage component 140 on the ground cover 110-*a* for storage while not in use. The one or more storage components 140 may be a fabric pouch, plastic or other rigid mold, elastomeric case, or any other composition. When the one or more stakes 120-*a* may be in their respective storage component 140, the one or more stakes 120-*a* may also act as a weighted corner or edge for the ground cover 110-*a*.

In some embodiments, the first layer of material of each respective storage component 140 includes at least one free edge; the first layer of material and a portion of the ground cover 110-*a* may form a pocket. In some embodiments, each of the one or more stakes 120-*a* is stored in the pocket of a respective one of the one or more storage components 140. In some embodiments, each pocket is configured to receive a weighting material separate from the one or more stakes 120-*a*. In some embodiments, the second layer of material of each respective storage component 140 includes at least one free edge; the first layer of material, the second layer of material, and/or a portion of the ground cover 110-*a* may form a pocket.

For example, the one or more storage components 140 may be part of or form one or more corner sections or flaps, which may be constructed so that they can be filled with sand, gravel, dirt, or other material in order to weight the corners or edges of the ground cover 110-*a* against wind or other disturbances in some embodiments. These flaps may be located on the top or the bottom surface of the ground cover 110-*a*, and on any edge or corner of the ground cover 110-*a*. There may be any number of flaps present, including the possibility of only a single flap; some embodiments include four flaps. These flaps may be of any size or shape including, but not limited to, triangular or square. The flaps may have at least one edge attached to the main body of the ground cover 110-*a* and one open edge to allow filling with loose material. These flaps may be intended to create a pocket that may accept loose material to increase the weight of the ground cover 110-*a*. In some embodiments, the flaps are triangular and are attached to the ground cover 110-*a* along two edges. This may leave a third edge open to receive loose material as added weight. For flaps with more than three sides, one or more edges may be attached to the ground cover 110-*a* and one or more edges may not be attached to create a pocket or flap.

These flaps may be constructed from a single layer of fabric or with multiple overlapping layers of fabric. There may be no limit to the number of layers that may be used to construct the flap. In some embodiment, the flap is constructed with two overlapping layers of fabric; some embodiments may utilize a single layer of fabric. The pocket created between the two overlapping layers of fabric can be used as a pocket to form the storage component 140. This pocket may be used to store any item of appropriate size. In general, the pocket formed may be used to store the tethered stakes 120-*a*.

The one or more stakes 120-*a* may or may not be stored between the two layers of material that create the flap for a respective storage component 140. There may be an opening in one of the one or more layers used to create the flap so that the each stake 120-*a* or other items may be placed between the two or more layers as part of the storage component 140. The one or more stakes 120-*a* may also be stored entirely beneath the one or more elements that that may create the flap. In this embodiment, each stake 120-*a* may be stored in the pocket, which may be treated as the storage component 140, that may be intended to receive loose material to increase overall weight of the system 100-*a*. In some embodiments, one or more stakes 120-*a* may also be stored outside of the flap entirely. In some embodiments, one or more stakes 120-*a* may not be stored within or beneath the flap.

When not deployed, the one or more stakes 120-*a* may function as additional weights to keep the ground cover 110-*a* in place against disturbances. In some embodiments, the one or more stakes 120-*a* are stored between the multiple layers of material used to construct the flap as a storage component 140. The one or more stakes 120-*a* may be constructed of a relatively dense material so that their weight may be utilized to protect against mild disturbances. In some embodiments, the one or more stakes 120-*a* act as corner weights when they are in the storage state.

Some embodiments of the system 100-*a* may include one or more catches configured to hinder the one or more stakes 120-*a* from slipping out from a respective storage component 140. In some embodiments, the one or more catches include at least a loop or a protrusion formed as part of the one or more tethers 130. In some embodiments, the one or more catches include a protrusion formed as part of each respective stake 120-*a* or attached with a respective stake 120-*a*. In some embodiments, the one or more catches are positioned with respect to each respective stake 120-*a* such that each catch catches underneath a portion of the first layer of material of a respective storage component 140 proximal to the opening through the first layer of material. The one or more catches may help prevent the one or more stakes 110-*a* from slipping out of the respective storage components 140 unbeknownst to the user, for example.

In some embodiments of the system 100-*a*, the one or more stakes 120-*a* include four stakes. In some embodiments, each respective storage component 140 is configured such that a central axis of each of the four stakes 120-*a* is substantially parallel with the central axes of the other stakes 120-*a* when the four stakes 120-*a* are stowed in respective storage components 140. In some embodiments, each stake 120-*a* includes a flat material. In some embodiments, each stake 120-*a* includes a metallic material.

Figure 2A:
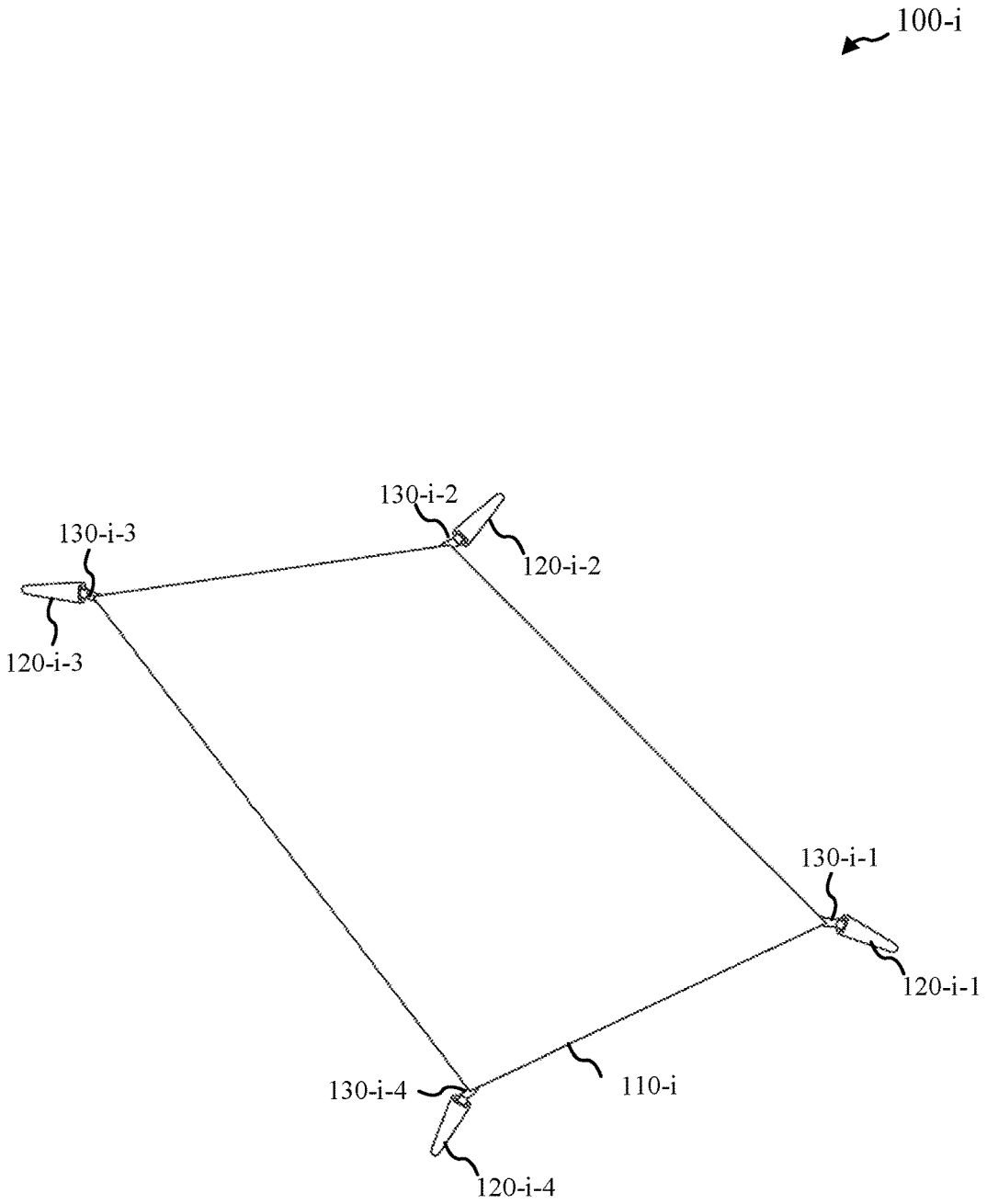
FIG. 2A and FIG. 2B show a system in accordance with various embodiments
Figure 2B:
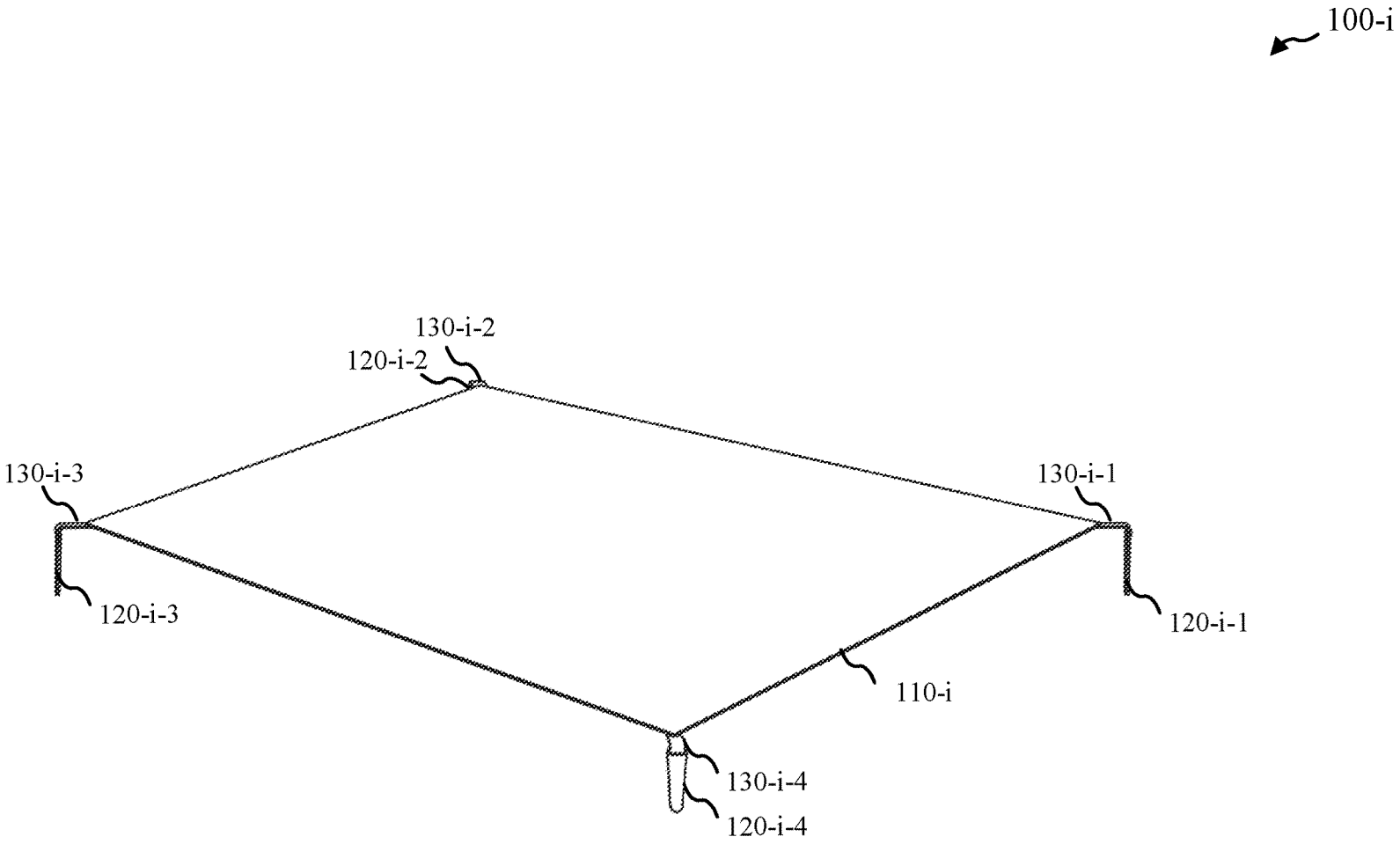

Turning now to FIG. 2A and FIG. 2B, a system 100-*i* in accordance with various embodiments. System 100-*i* may be an example of system 100 of FIG. 1A and/or system 100-*a* of FIG. 1B, for example. System 100-*i* may include a ground cover 110-*i* that may be coupled with stakes 120-*i*-1, 120-*i*-2, 120-*i*-3, and/or 120-*i*-4 utilizing tethers 130-*i*-1, 130-*i*-2, 130-*i*-3, and/or 130-*i*-4; while system 100-*i* may utilize four stakes and four tethers, other embodiments may utilize more or fewer stakes and/or tethers. Tethers 130-*i*-1, 130-*i*-2, 130-*i*-3, and/or 130-*i*-4 may include one or more elastic materials in some embodiments.

FIG. 2A and FIG. 2B may show a specific example where the one or more elastic materials of tethers 130-*i*-1, 130-*i*-2, 130-*i*-3, and/or 130-*i*-4 include one or more flat elastic bands. In some embodiments, the one or more elastic materials include one or more round elastic chords. The elasticity of the tethers 130-*i*-1, 130-*i*-2, 130-*i*-3, and/or 130-*i*-4 may help keep the ground cover 110-*i* stretched tightly across the ground even when acted upon by external forces including, but not limited to, wind and ground cover users. The elasticity may also make the stakes 120-*i*-1, 120-*i*-2, 120-*i*-3, and/or 120-*i*-4 less likely to be pulled from the ground since the elastic tethers 130-*i*-1, 130-*i*-2, 130-*i*-3, and/or 130-*i*-4 may have introduced some flexibility into the ground cover tethering system. FIG. 2B may show an example where the tethers 130-*i*-1, 130-*i*-2, 130-*i*-3, and/or 130-*i*-4 may be stretched and the stakes 120-*i*-1, 120-*i*-2, 120-*i*-3, and/or 120-*i*-4 oriented with respect to the ground to facilitate these properties; the stakes 120-*i*-1, 120-*i*-2, 120-*i*-3, and/or 120-*i*-4 may be shown such that they are driven into the ground to secure the ground cover 110-*i*. In general, the stakes 120-*i*-1, 120-*i*-2, 120-*i*-3, and/or 120-*i*-4 may be coupled with the ground cover 110-*i* such that the stakes 120-*i*-1, 120-*i*-2, 120-*i*-3, and/or 120-*i*-4 may be driven into the ground to secure the ground cover 110-*i*. These stakes 120-*i*-1, 120-*i*-2, 120-*i*-3, and/or 120-*i*-4 may be constructed of metal, plastic, wood, composite, and/or any other rigid material. FIG. 2A and FIG. 2B may show a specific example where the stakes 120-*i*-1, 120-*i*-2, 120-*i*-3, and/or 120-*i*-4 are formed from a flat, metallic material. In general, the stakes 120-*i*-1, 120-*i*-2, 120-*i*-3, and/or 120-*i*-4 may be attached to the ground cover 110-*i* via elastic, string, rope, or other flexible materials as the tethers 130-*i*-1, 130-*i*-2, 130-*i*-3, and/or 130-*i*-4.

Figure 3B:
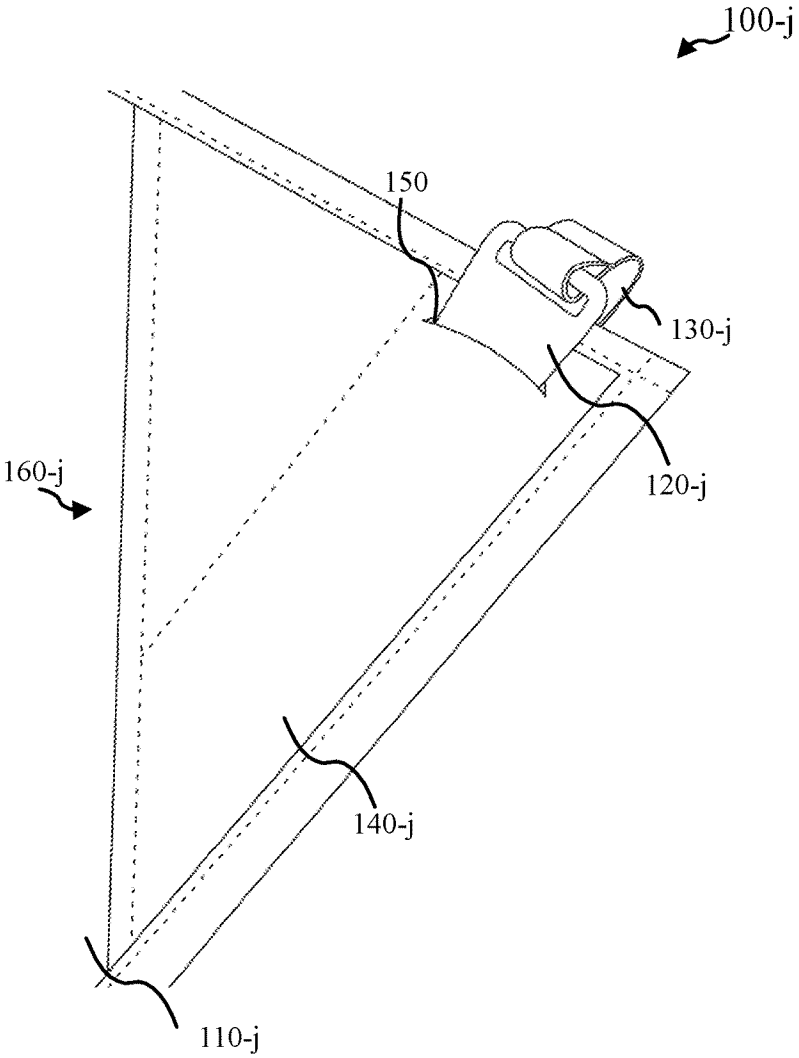
FIG. 3A, FIG. 3B, and FIG. 3C show aspects of a system in accordance with various embodiments.
Figure 3A:
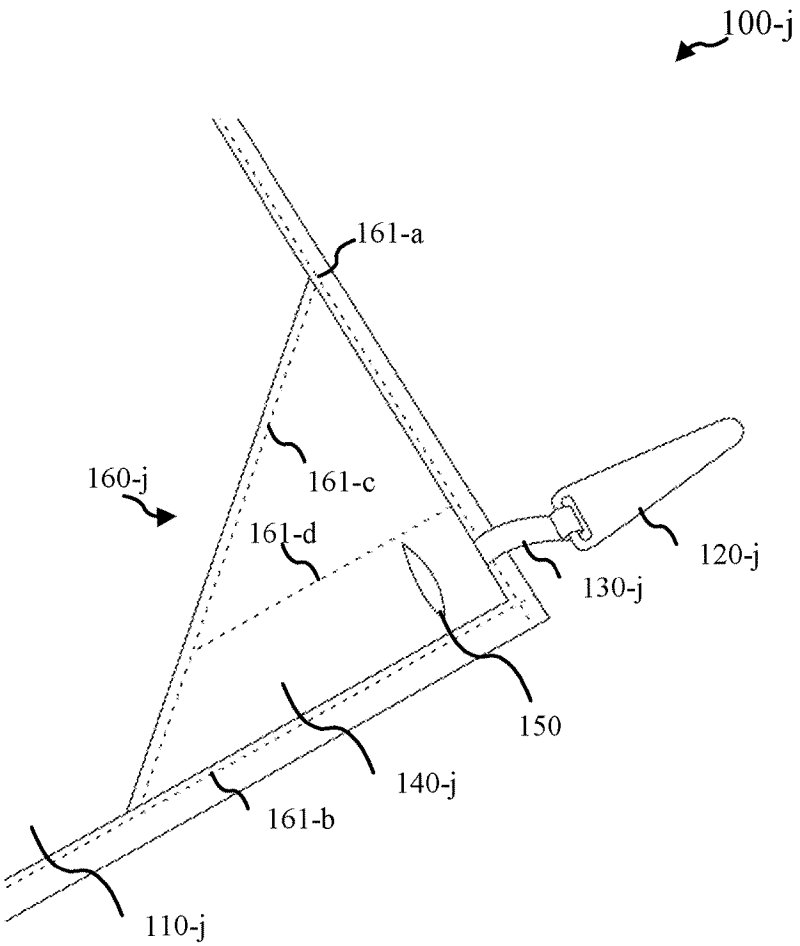
Figure 3D:
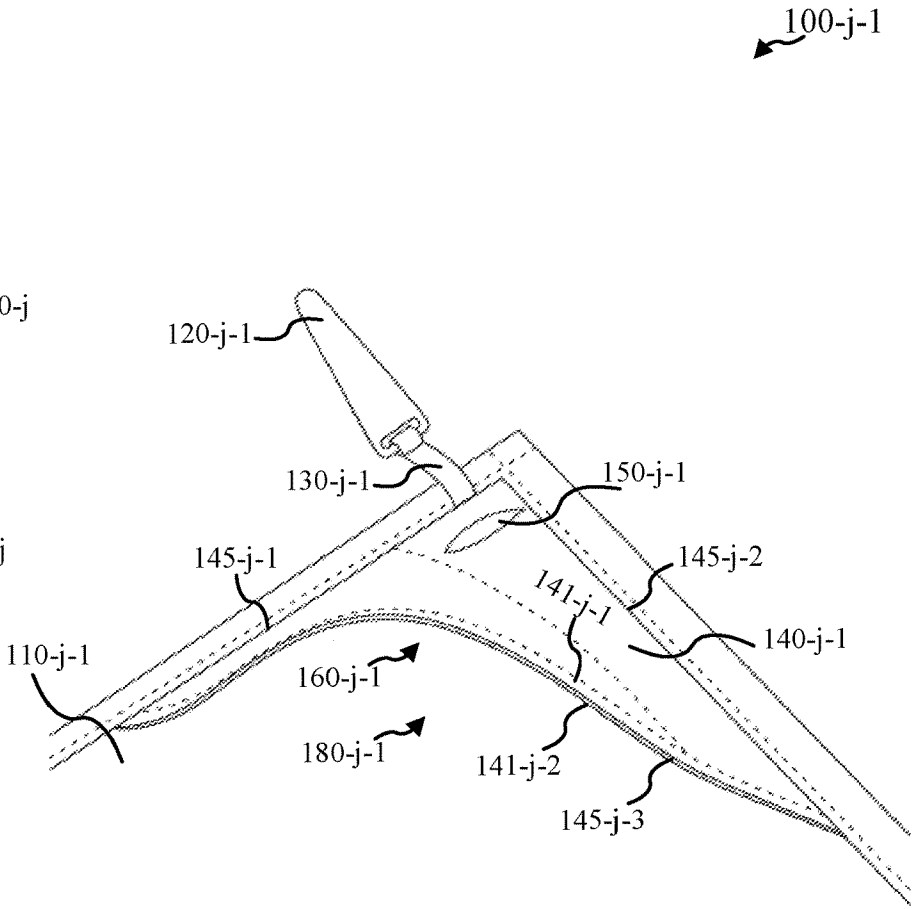
FIG. 3D shows aspects of a system in accordance with various embodiments.
Figure 3C:
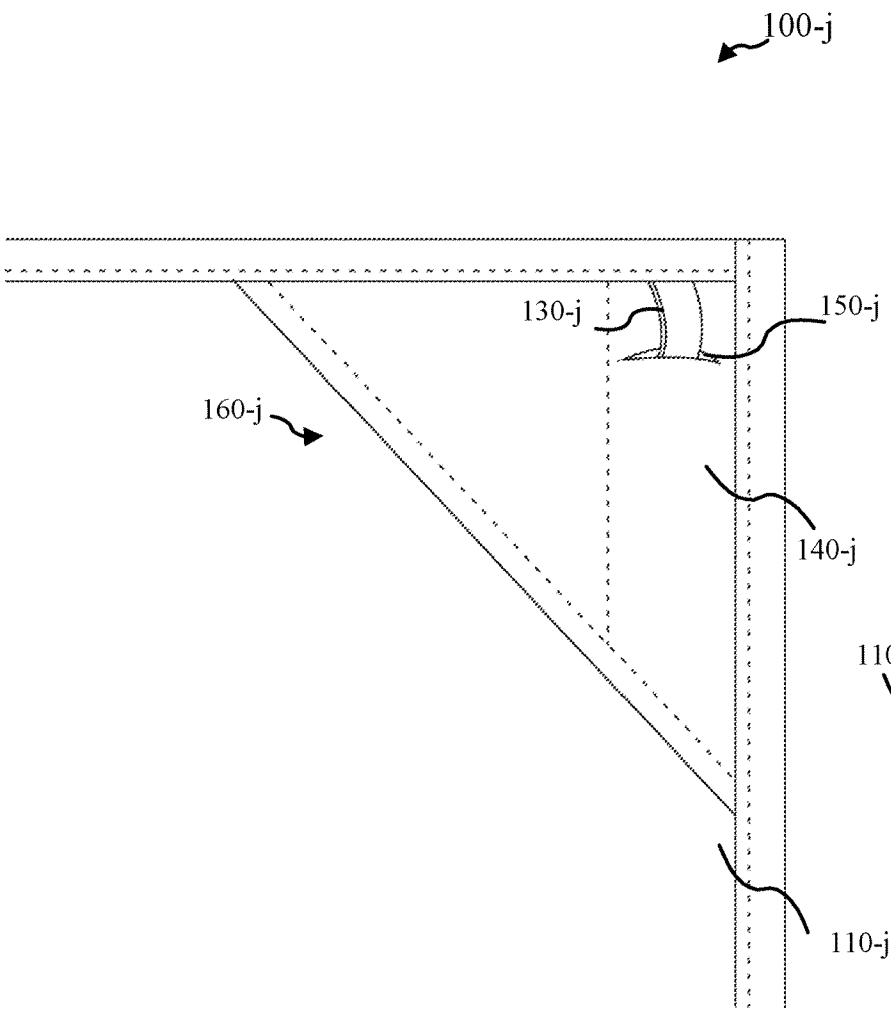

FIG. 3A, FIG. 3B, and FIG. 3C show aspects of a system 100-*j* in accordance with various embodiments. System 100-*j* may be an example of aspects of system 100 of FIG. 1A, system 100-*a* of FIG. 1B, and/or system 100-*i* of FIG. 2A and/or FIG. 2B. System 100-*j* may highlight a corner portion of the system 100-*j*, which may include a stake 120-*j* and a storage component 140-*j*. The stake 120-*j* may be coupled to a ground cover 110-*j* utilizing a tether 130-*j*, which may be a flat, elastic band in this example, though other shapes and materials may be utilized. The stake 120-*j* may be formed from a flat, metallic material in this example, though other shapes and materials may be utilized. The stake 120-*j* may pack away into the storage component 140-*j* coupled with the ground cover 110-*j* for storage while not in use, for example. In some embodiments, the storage component 140-*j* may be considered as part of a corner portion 160-*j* of the system 100-*j*. The sequence of figures may generally show the stake 120-*j* completely outside the storage component 140-*j* in FIG. 3A. FIG. 3B may then show the stake 120-*j* partially inserted into the storage component 140-*j* through an opening 150 formed with respect to the storage component 140-*j*, while FIG. 3C may show a situation where the stake 120-*j* is fully packed away in storage component 140-*j*.

The storage component 140-*j* may be a fabric pouch, plastic, or other rigid mold, elastomeric case, or any other composition. The storage component 140-*j* may be formed from one or more layers of material; FIG. 3A, FIG. 3B, and FIG. 3C may show a first layer of material as part of the storage component 140-*j* and/or corner portion 160-*j*. When the stake 120-*j* is in its storage component 140-*j*, it may also act as a weighted corner or edge for the ground cover 110-*j*. FIG. 3A, FIG. 3B, and/or FIG. 3C may also show different sew lines (represented as short dashed lines 161-*a*, 161-*b*, 161-*c*, and/or 161-*d*), which may reflect different seams sewn into the ground cover 110-*j*, corner portion 160-*j*, and/or storage component 140-*j*. In some embodiments, sew line 161-*d* may form an edge of storage component 140-*j*, which may help keep the stake 120-*j* oriented in a specific direction when stored. Sew line 161-*c* and/or 161-*d* may reflect that a second layer of material may be sewn or otherwise coupled with the first layer of material, which may form the storage component 140-*j*. In some embodiments, the first layer of material may be coupled with the ground cloth 110-*j* to form the storage component 140-*j*.

FIG. 3D shows a portion of a system 100-*j*-1 in accordance with various embodiments. System 100-*j*-1 may be an example of system 100-*j* of FIG. 3A, FIG. 3B, and/or FIG. 3C. In this embodiment, the corner portion 160-*j*-1 may form a pocket 180-*j*-1 with respect to at least a portion of ground cover 110-*j*-1. In some embodiments, the corner portion 160-*j*-1 that may form a pocket 180-*j*-1 may be referred to as a flap. Pocket 180-*j*-1 may be constructed so that it may be filled with sand, gravel, dirt, or other material to weight the corners or edges of the ground cover 110-*j*-1 against wind or other disturbances. Pocket 180-*j*-1 may be located on the top or the bottom surface of the ground cover 110-*j*-1, and on any edge or corner of the ground cover 110-*j*-1. There could be any number of pockets 180-*j*-1 present, including the possibility of only a single pocket; some embodiments include four pockets. These pockets 180-*j*-1 may be of any size or shape including, but not limited to, triangular or square. The corner portion 160-*j*-1 that may form pocket 180-*j*-1 may have at least one edge, such as edge 145-*j*-1 and/or 145-*j*-2, attached to the main body of the ground cover 110-*j*-1 and one open edge 145-*j*-3 to allow filling with weighting material. Pocket 180-*j*-1 may thus be configured to receive a weighting material separate from the stake 120-*j*-1. In some embodiments, the corner portion 160-*j*-1 is triangular and is attached to the ground cover 110-*j*-1 along two edges, such as edges 145-*j*-1 and 145-*j*-2. This may leave third edge 145-*j*-3 open to receive weighting material as added weight. For a corner portion with more than three sides, one or more edges may be attached to the ground cover 110-*j*-1 and one or more edges may not be attached to create the pocket 180-*j*-1 or flap 160-*j*-1.

One may note that system 100-*j*-1 may also include a storage component 140-*j*-1 coupled with the ground cover 110-*j*-1, which may be configured to stow stake 120-*j*-1. In some embodiments, storage component 140-*j*-1 includes a first layer of material 141-*j*-1 coupled with the ground cover 110-*j*-1 and an opening 150-*j*-1 through the first layer of material 141-*j*-1 to allow the stake 120-*j*-1 to be stored between the first layer of material 141-*j*-1 and a portion of the ground cover 110-*j*-1. Storage component 140-*j*-1 may include a second layer of material 141-*j*-2 coupled with the ground cover 110-*j*-1 such that stake 120-*j*-1 is stored between the first layer of material 141-*j*-1 and the second layer of material 141-*j*-2.

In some embodiments, the first layer of material 141-*j*-1 of storage component 140-*j*-1 (or corner portion/flap 160-*j*-1) includes at least one free edge, such as edge 145-*j*-3; the first layer of material 141-*j*-1 and a portion of the ground cover 110-*j*-1 may form pocket 180-*j*-1. The second layer of material 141-*j*-2 of storage component 140-*j*-1 (or corner portion/flap 160-*j*-1) includes at least one free edge, such as the edge 145-*j*-3 that it may have in common with the first layer of material 141-*j*-1. The first layer of material 141-*j*-1, the second layer of material 141-*j*-2, and/or a portion of the ground cover 110-*j*-1 may form pocket 180-*j*-1.

The stake 120-*j*-1 may be coupled to ground cover 110-*j*-1 utilizing a tether 130-*j*-1, which may be a flat, elastic band in this example, though other shapes and materials may be utilized. The stake 120-*j*-1 may be formed from a flat, metallic material in this example, though other shapes and materials may be utilized.

Figure 4B:
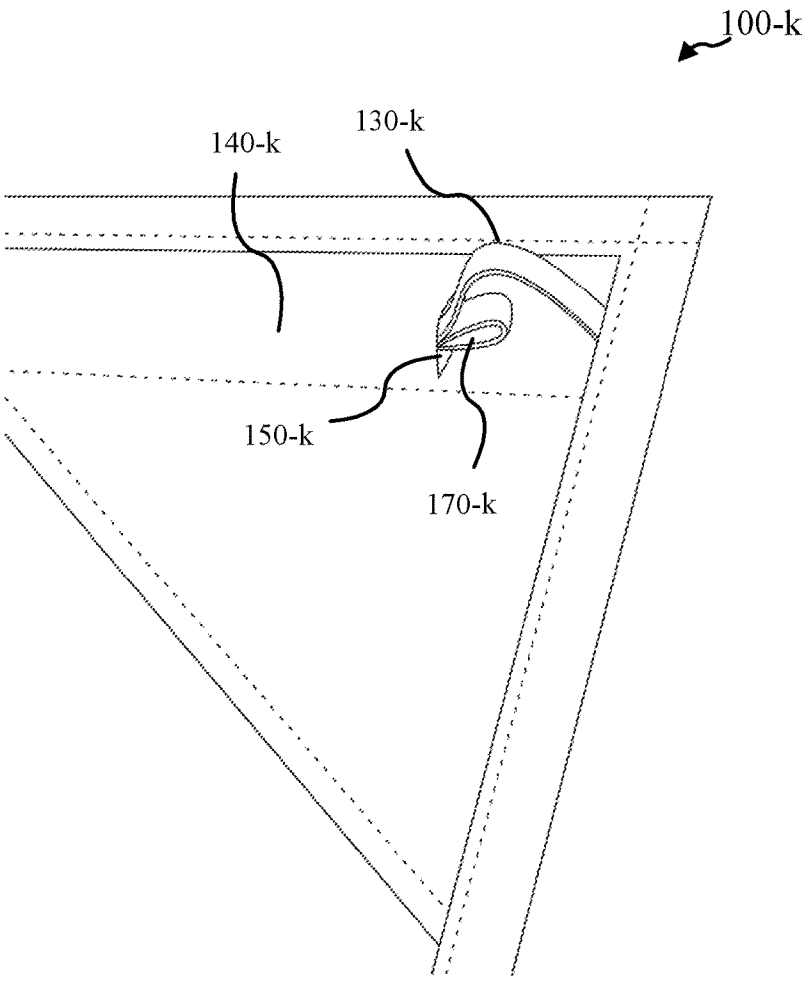
FIG. 4A and FIG. 4B show aspects of a system in accordance with various embodiments.
Figure 4A:
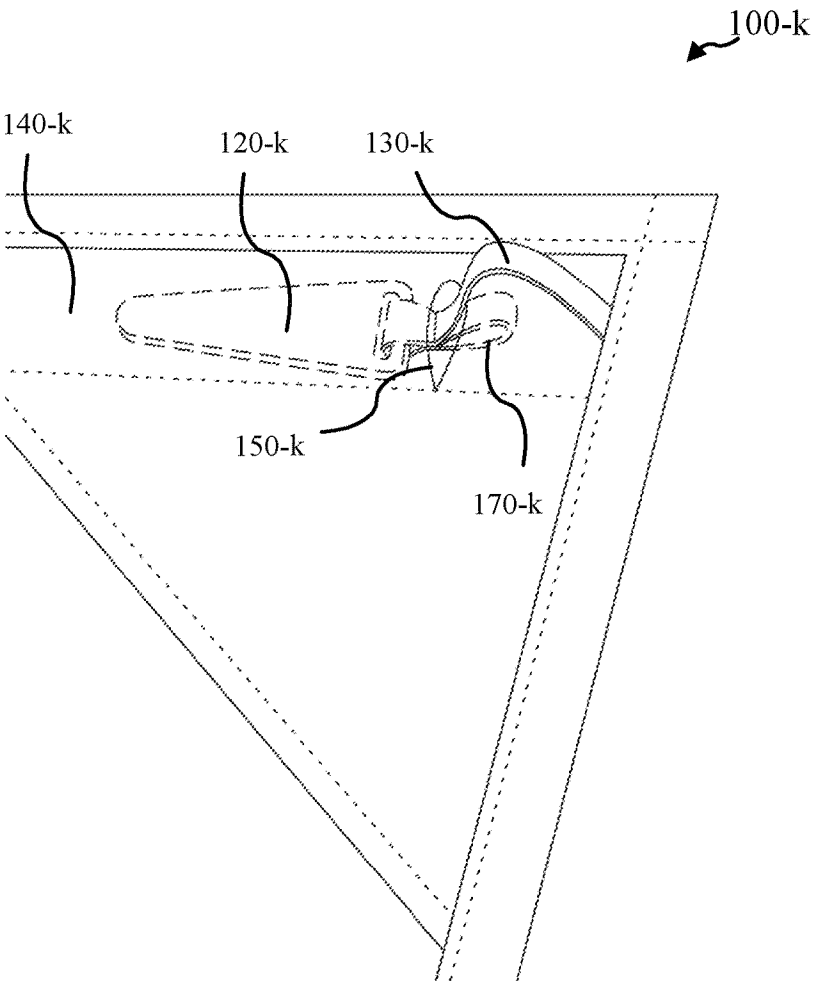

Turning now to FIG. 4A and FIG. 4B, a portion of a system 100-*k* in accordance with various embodiments is provided. System 100-*k* may be an example of system 100 of FIG. 1A, system 100-*a* of FIG. 1B, system 100-*i* of FIG. 2A and/or FIG. 2B, system 100-*j* of FIG. 3A, FIG. 3B, and/or FIG. 3C, and/or system 100-*j*-1 of FIG. 3D. These embodiments may show examples of one or more catches, such as catch 170-*k*, that may be configured to hinder the one or more stakes, such as stake 120-*k*, from slipping out from a respective storage component, such as storage component 140-*k*. For example, the use of catch 170-*k* may prevent the stake 120-*k* from slipping out from the storage component 140-*k* unbeknownst to the user and/or when not in use. The catch 170-*k* may include at least a loop or a protrusion formed as part of the one or more tethers 130-*k*, as may be shown in FIG. 4A and/or FIG. 4B. In some embodiments, the catch 170-*k* is positioned with respect to stake 120-*k* such that the catch 170-*k* catches underneath a portion of the first layer of material of storage component 140-*k* proximal to the opening 150-*k* through the first layer of material; this may be seen with respect to FIG. 4A, where the stake 120-*k* and catch 170-*k* may be seen through the first layer of material, with the catch 170-*k* catching a portion of the first layer of material proximal to the opening 150-*k*. FIG. 4B may show the catch 170-*k* before it has been moved to within the storage component 140-*k* or after it has been removed from the storage component 140-*k*.

Figure 4D:
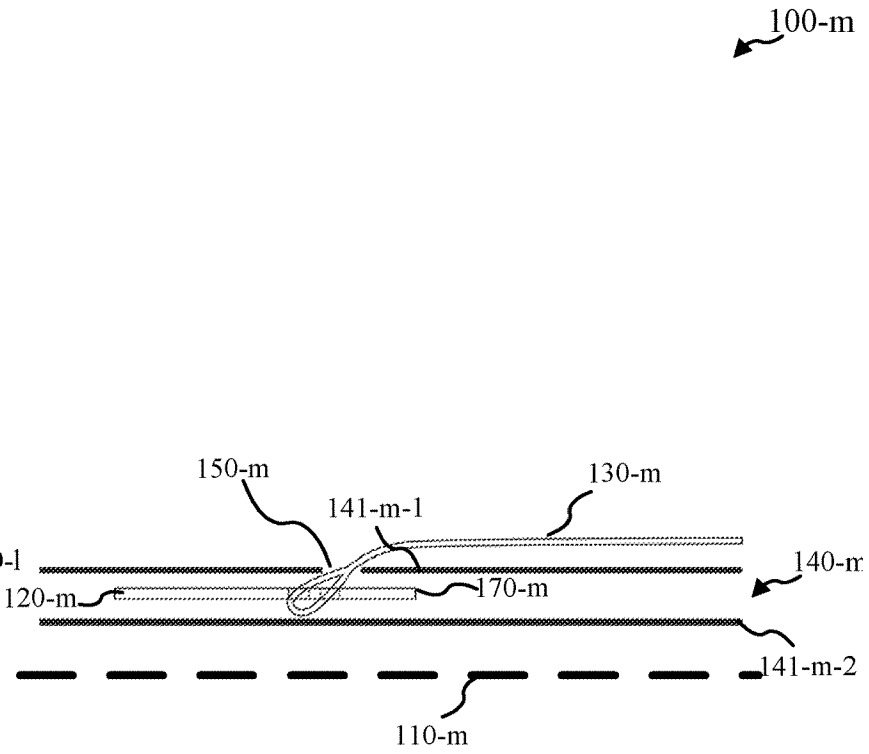
FIG. 4D shows aspects of a system in accordance with various embodiments.
Figure 4C:
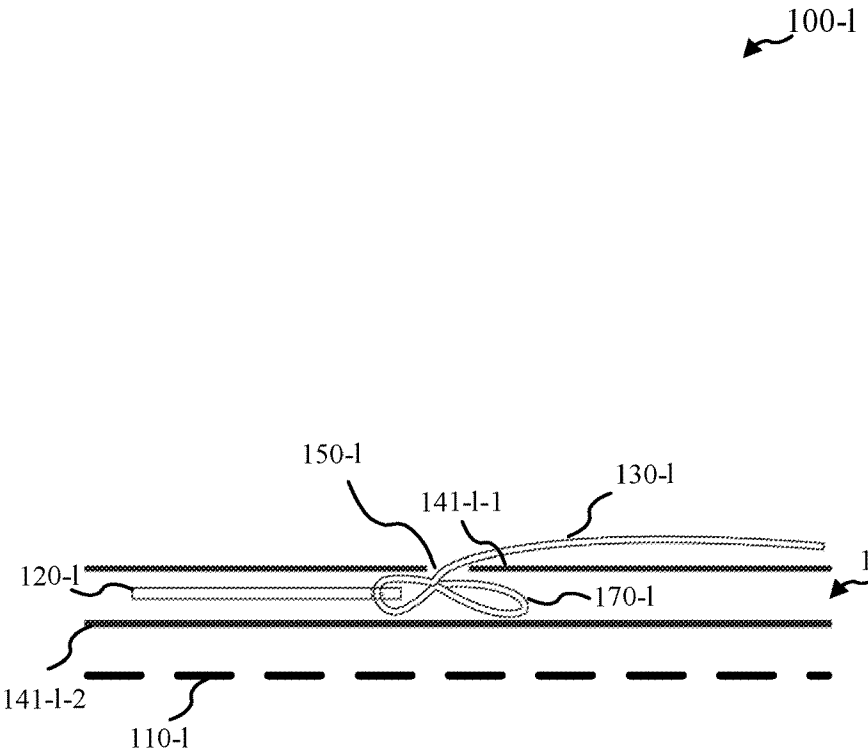
FIG. 4C shows aspects of a system in accordance with various embodiments.

FIG. 4C and FIG. 4D may then provide cross-sectional views of aspects of systems 100-*l* and 100-*m*, respectively, in accordance with various embodiments. Systems 100-*l* and/or 100-*m* may show different forms of catches when a stake is stowed within a storage component and the catches are positioned to hinder the stakes from slipping out from the storage component. For example, system 100-*l* of FIG. 4C may show a catch 170-*l* that may include at least a loop or a protrusion formed as part of tether 130-*l*, which may be coupled with stake 120-*l*. This may be similar to the catch 170-*k* shown in FIG. 4A. The catch 170-*l* may be positioned with respect to stake 120-*l* such that the catch 170-*l* catches underneath a portion of the first layer of material 141-*l*-1 of storage component 140-*l* proximal to the opening 150-*l* through the first layer of material 141-*l*-1. System 100-*l* may also show a second layer of material 141-*l*-2, which may be a part of the storage component 140-*l*. In some embodiments, the second layer of material 141-*l*-2 may be a portion of the ground cover; some embodiments may include the second layer of material 141-*l*-2 that is a separate layer different that the ground cover, such as ground cover 110-*l*.

System 100-*m* of FIG. 4D may show a catch 170-*m* that may include a protrusion formed as part of stake 120-*m* or attached with stake 120-*m*. The catch 170-*m* may be positioned with respect to stake 120-*m* such that the catch 170-*m* catches underneath a portion of the first layer of material 141-*m*-1 of storage component 140-*m* proximal to the opening 150-*m* through the first layer of material 141-*m*-1. System 100-*m* may also show a second layer of material 141-*m*-2, which may be a part of the storage component 140-*m*. In some embodiments, the second layer of material 141-*m*-2 may be a portion of the ground cover; some embodiments may include the second layer of material 141-*m*-2 that is a separate layer different that the ground cover, such as ground cover 110-*m*.

There may be other ways to prevent a stake 120 from slipping from its storage component 140 when not in use, including, but not limited to, the use of Velcro or opening flaps. Systems 100-*l* and/or 100-*m* may be examples of system 100 of FIG. 1A, system 100-*a* of FIG. 1B, system 100-*i* of FIG. 2A and/or FIG. 2B, system 100-*j* of FIG. 3A, FIG. 3B, and/or FIG. 3C, system 100-*j*-1 of FIG. 3D, and/or system 100-*k* of FIG. 4A and/or FIG. 4B.

Figure 5B:
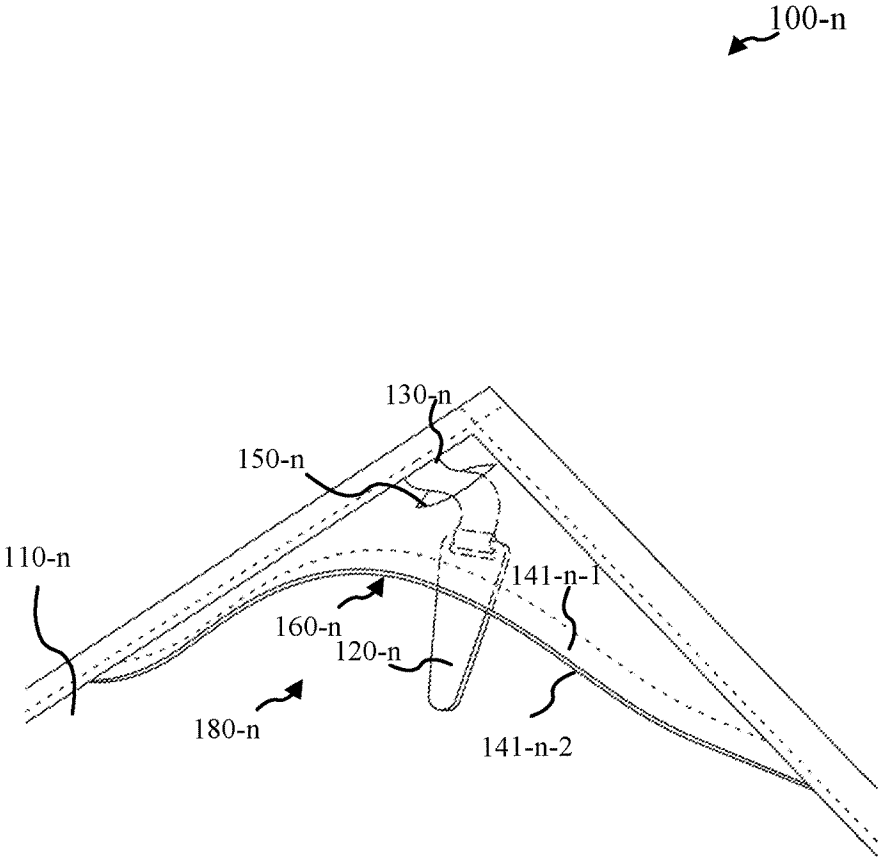
FIG. 5A and FIG. 5B show a system in accordance with various embodiments.
Figure 5A:
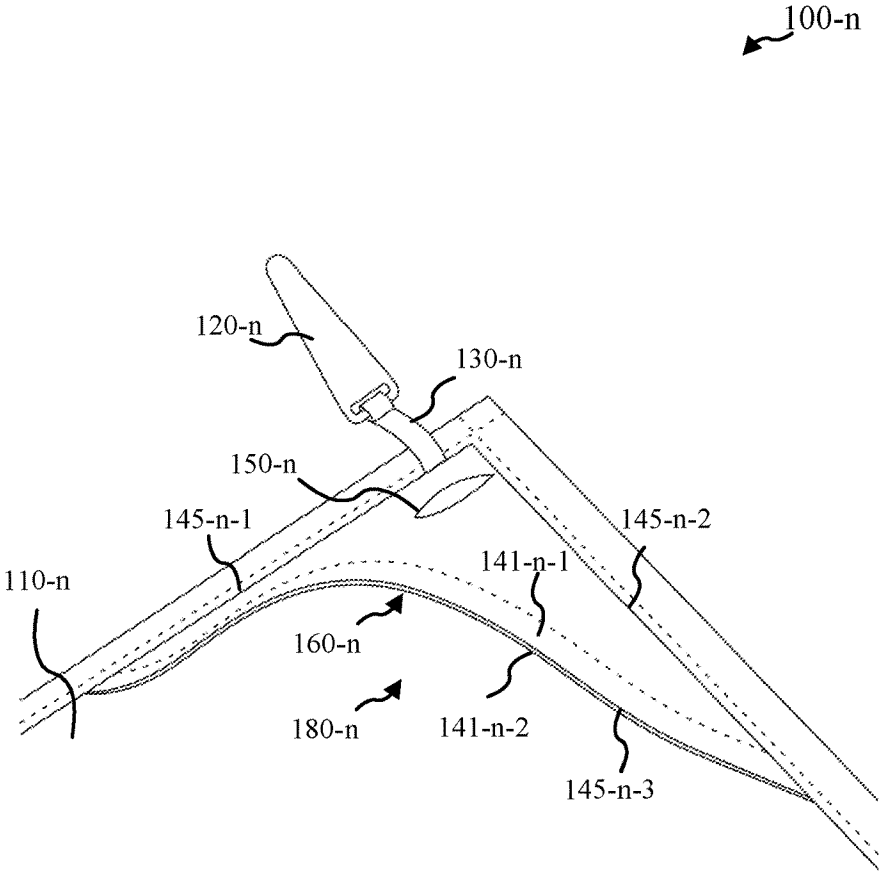

Turning now to FIG. 5A and FIG. 5B, aspects of a system 100-*n* is shown in accordance with various embodiments. Systems 100-*n* and/or 100-*m* may be examples of system 100 of FIG. 1A, system 100-*a* of FIG. 1B, system 100-*i* of FIG. 2A and/or FIG. 2B, system 100-*l* FIG. 4C, and/or system 100-*m* of FIG. 4D. In this embodiment, a corner portion 160-*n* may form a pocket 180-*n* with respect to at least a portion of ground cover 110-*n*. In some embodiments, the corner portion 160-*n* that may form the pocket 180-*n* may be referred to as a flap. Pocket 180-*n* may be constructed so that it may be filled with sand, gravel, dirt, or other material to weight the corners or edges of the ground cover 110-*n* against wind or other disturbances. Pocket 180-*n* may be located on the top or the bottom surface of the ground cover 110-*n*, and on any edge or corner of the ground cover 110-*n*. There could be any number of pockets 180-*n* present, including the possibility of only a single pocket; some embodiments include four pockets. These pockets can be of any size or shape including, but not limited to, triangular or square. The corner portion 160-*n* that may form pocket 180-*n* may have at least one edge, such as edge 145-*n*-1 and/or 145-*n*-2, attached to the main body of the ground cover 110-*n* and one open edge 145-*n*-3 to allow filling with weighting material. Pocket 180-*n* may thus be configured to receive a weighting material separate from the stake 120-*n*. In some embodiments, the corner portion 160-*n* is triangular and is attached to the ground cover 110-*n* along two edges, such as edges 145-*n*-1 and 145-*n*-2. This may leave third edge 145-*n*-3 open to receive weighting material as added weight. For a corner portion with more than three sides, one or more edges may be attached to the ground cover 110-*n* and one or more edges may not be attached to create the pocket 180-*n* or flap 160-*n*.

In some embodiments, the corner portion or flap 160-*n* may be formed from a first layer of material 141-*n*-1, which may includes at least one free edge, such as edge 145-*n*-3; the first layer of material 141-*n*-1 and a portion of the ground cover 110-*n* may form pocket 180-*n*. In some embodiments, the corner portion or flap 160-*n* may include a second layer of material 141-*n*-2 that may include at least one free edge, such as the edge 145-*n*-3 that it may have in common with the first layer of material 141-*n*-1. The first layer of material 141-*n*-1, the second layer of material 141-*n*-2, and/or a portion of the ground cover 110-*n* may form pocket 180-*n*.

As may be shown in FIG. 5B, the stake 120-*n* may be stored in the pocket 180-*n*; the pocket 180-*n* along with the corner portion or flap 160-*n* may be an example of storage component (generally referred to with reference number 140 elsewhere). The stake 120-*n* may be positioned within pocket 180-*n* through being moved through opening 130-*n*. In some embodiments, the pocket 180-*n* may be configured to receive a weighting material separate from stake 120-*n*. The stake 120-*n* may thus be stored entirely beneath the assembly that creates the flap 160-*n*. In this embodiment, the stake 180-*n* may be stored in the pocket 180-*n* that may be intended to receive loose material to increase overall weight of the system 100-*n*.

Figure 6:
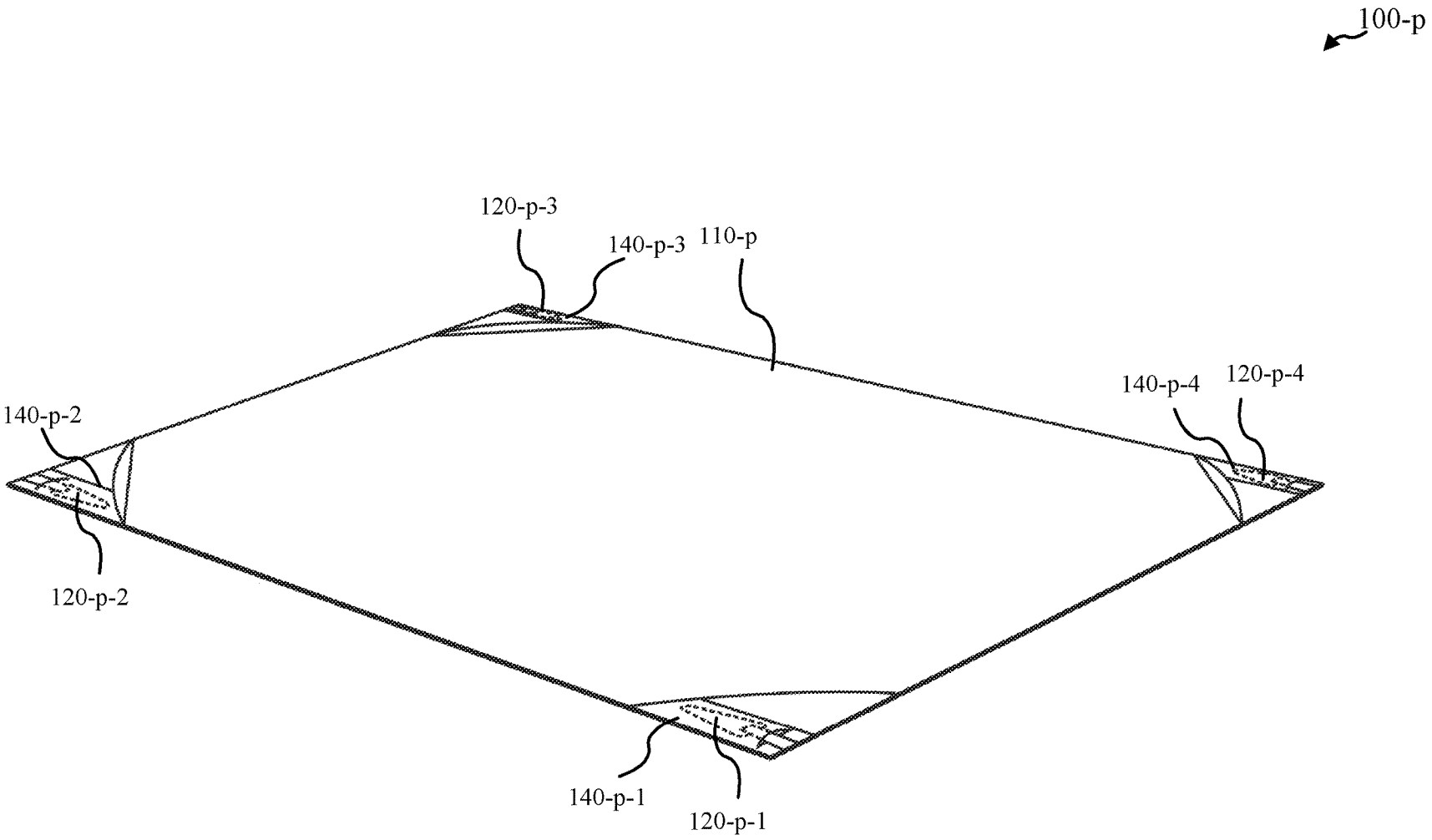
FIG. 6 shows a system in accordance with various embodiments.

Turning now to FIG. 6, a system 100-*p* in accordance with various embodiments is provided. System 100-*p* may be an example of system 100 of FIG. 1A, system 100-*a* of FIG. 1B, system 100-*i* of FIG. 2A and/or FIG. 2B, system 100-*j* of FIG. 3A, FIG. 3B, and/or FIG. 3C, system 100-*j*-1 of FIG. 3D, system 100-*k* of FIG. 4A and/or FIG. 4B, system 100-*l* of FIG. 4C, system 100-*m* of FIG. 4D, and/or system 100-*n* of FIG. 5A and/or FIG. 5B.

System 100-*p* may include four stakes 120-*p*-1, 120-*p*-2, 120-*p*-3, and/or 120-*p*-4 that may be shown stowed in respective storage components 140-*p*-1, 140-*p*-2, 140-*p*-3, and/or 140-*p*-4. As may be seen, each respective storage component 140-*p*-1, 140-*p*-2, 140-*p*-3, and/or 140-*p*-4 may be configured such that a central axis of each of the four stakes 120-*p*-1, 120-*p*-2, 120-*p*-3, and 120-*p*-4 may be substantially parallel with the central axes of the other stakes 120-*p*-1, 120-*p*-2, 120-*p*-3, and/or 120-*p*-4 when the four stakes 120-*p*-1, 120-*p*-2, 120-*p*-3, and/or 120-*p*-4 are stowed in respective storage components 140-*p*-1, 140-*p*-2, 140-*p*-3, and/or 140-*p*-4. In some embodiments, each stake 120-*p*-1, 120-*p*-2, 120-*p*-3, and/or 120-*p*-4 includes a flat material. In some embodiments, each stake 120-*p*-1, 120-*p*-2, 120-*p*-3, and/or 120-*p*-4 includes a metallic material. This storage confirmation may facilitate an overall compact storage of the system 100-*p* when it may be folded up. For example, the four stakes 120-*p*-1, 120-*p*-2, 120-*p*-3, and/or 120-*p*-4 may remain relatively parallel with each other when the ground cover 110-*p* may be folded up.

Figure 7A:
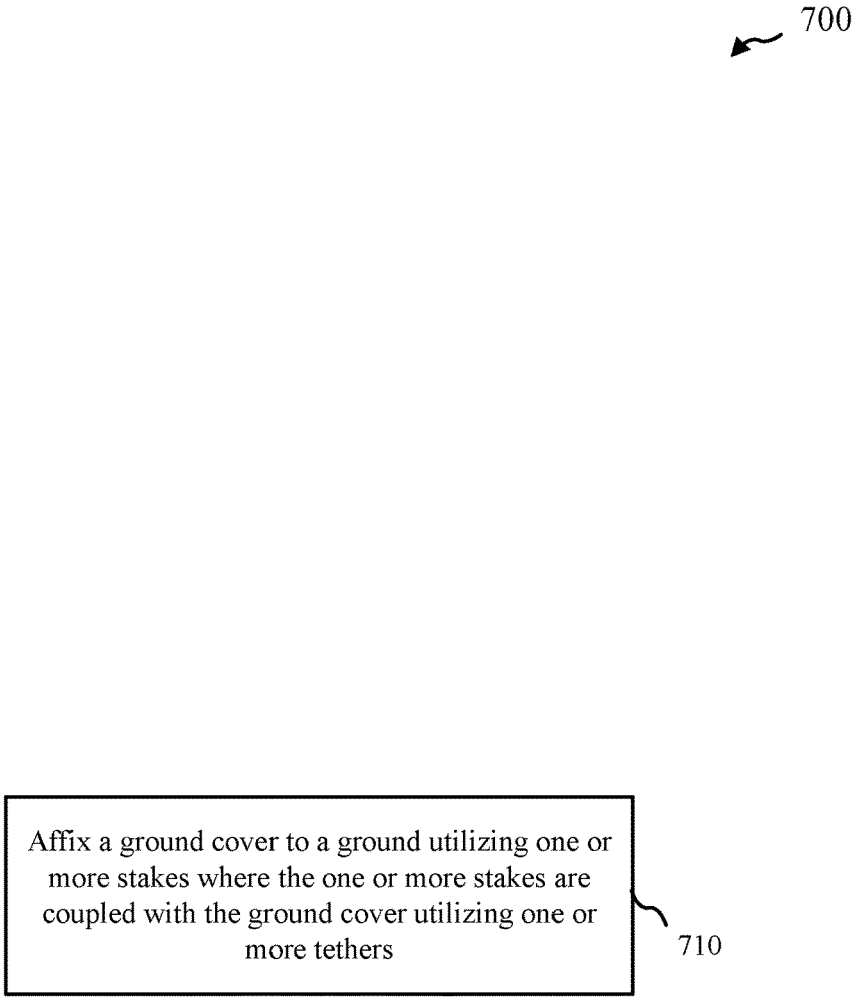
FIG. 7A shows a flow diagram of a method in accordance with various embodiments.

Turning now to FIG. 7A, a flow diagram of a method 700 is shown in accordance with various embodiments. Method 700 may be implemented utilizing a variety of systems and/or devices such as those shown and/or described with system 100 of FIG. 1A, system 100-*a* of FIG. 1B, system 100-*i* of FIG. 2A and/or FIG. 2B, system 100-*j* of FIG. 3A, FIG. 3B, and/or FIG. 3C, system 100-*j*-1 of FIG. 3D, system 100-*k* of FIG. 4A and/or FIG. 4B, system 100-*l* of FIG. 4C, system 100-*m* of FIG. 4D, system 100-*n* of FIG. 5A and/or FIG. 5B, and/or system 100-*p* of FIG. 6.

At block 710, a ground cover may be affixed to the ground utilizing one or more stakes, where the one or more stakes are coupled with the ground cover utilizing one or more tethers.

Figure 7B:
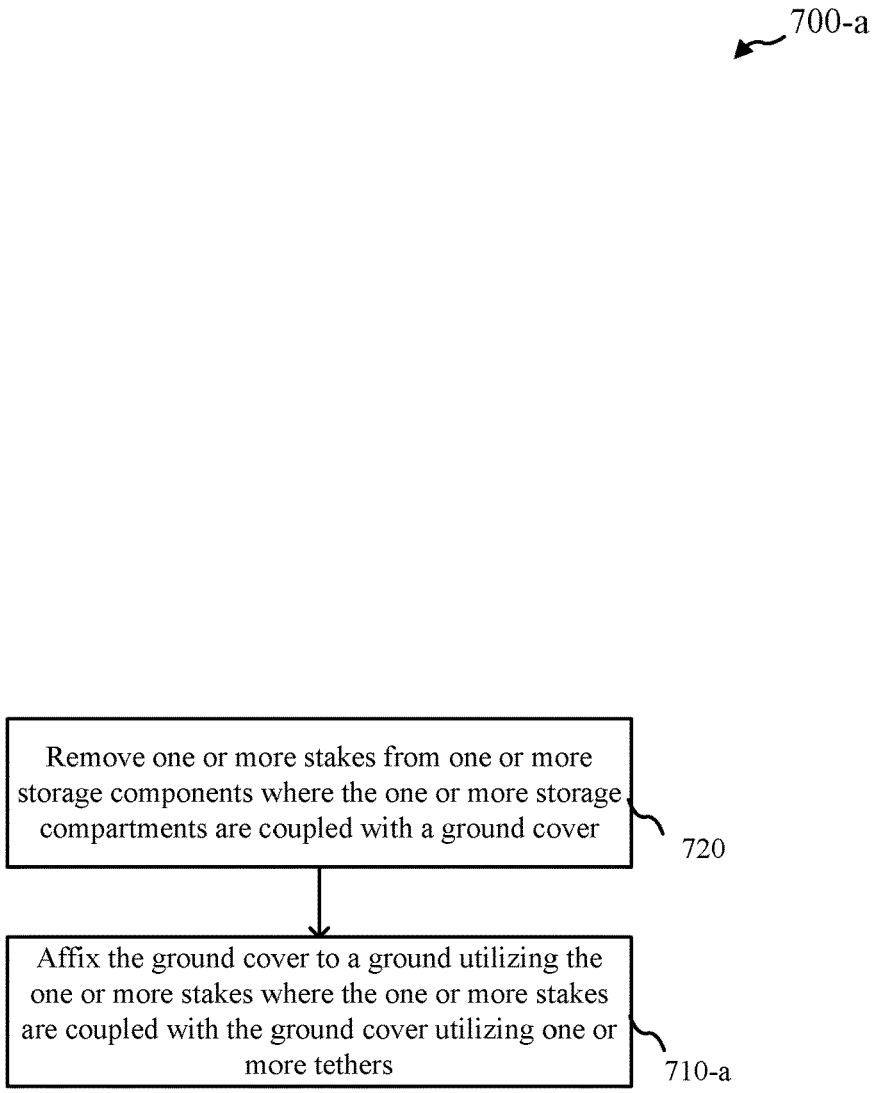
FIG. 7B shows a flow diagram of a method in accordance with various embodiments.

FIG. 7B shows a flow diagram of a method 700-*a* in accordance with various embodiments. Method 700-*a* may be implemented utilizing a variety of systems and/or devices such as those shown and/or described with system 100 of FIG. 1A, system 100-*a* of FIG. 1B, system 100-*i* of FIG. 2A and/or FIG. 2B, system 100-*j* of FIG. 3A, FIG. 3B, and/or FIG. 3C, system 100-*j*-1 of FIG. 3D, system 100-*k* of FIG. 4A and/or FIG. 4B, system 100-*l* of FIG. 4C, system 100-*m* of FIG. 4D, system 100-*n* of FIG. 5A and/or FIG. 5B, and/or system 100-*p* of FIG. 6. Method 700-*a* may be an example of method 700 of FIG. 7A.

At block 720, one or more stakes may be removed from one or more storage components where the one or more storage components are coupled with a ground cover. At block 710-*a*, the ground cover may be affixed to a ground utilizing the one or more stakes, where the one or more stakes are coupled with the ground cover utilizing one or more tethers. In some embodiments, the one or more tethers may be stretched in order to keep the ground cover stretched tightly across the ground. For example, the one or more tethers may include an elastic material. The elastic material may include a flat elastic band in some embodiments; some embodiments may utilize a round elastic chord.

These embodiments may not capture the full extent of combination and permutations of materials and process equipment. However, they may demonstrate the range of applicability of the method, devices, and/or systems. The different embodiments may utilize more or less stages than those described.

It should be noted that the methods, systems and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various stages may be added, omitted, or combined. Also, features described with respect to certain embodiments may be combined in various other embodiments. Different aspects and elements of the embodiments may be combined in a similar manner. Additionally, it should be emphasized that technology evolves and, thus, many of the elements are exemplary in nature and should not be interpreted to limit the scope of the embodiments.

Specific details are given in the description to provide a thorough understanding of the embodiments. However, it will be understood by one of ordinary skill in the art that the embodiments may be practiced without these specific details. For example, well-known circuits, processes, algorithms, structures, and techniques have been shown without unnecessary detail in order to avoid obscuring the embodiments.

Also, it is noted that the embodiments may be described as a process which may be depicted as a flow diagram or block diagram or as stages. Although each may describe the operations as a sequential process, many of the operations can be performed in parallel or concurrently. In addition, the order of the operations may be rearranged. A process may have additional stages not included in the figure.

Having described several embodiments, it will be recognized by those of skill in the art that various modifications, alternative constructions, and equivalents may be used without departing from the spirit of the different embodiments. For example, the above elements may merely be a component of a larger system, wherein other rules may take precedence over or otherwise modify the application of the different embodiments. Also, a number of stages may be undertaken before, during, or after the above elements are considered. Accordingly, the above description should not be taken as limiting the scope of the different embodiments.

What is claimed is:

1. A system comprising:

a ground cover;

a plurality of stakes coupled with the ground cover; and a plurality of storage components coupled with the ground cover, wherein each of the storage components from the plurality of storage compartments is configured to stow one stake from the plurality of stakes, wherein each of the storage components from the plurality of storage compartments includes:

a first layer of material coupled with the ground cover;

a second layer of material coupled with the ground cover such that the one stake from the plurality of stakes is stored between the first layer of material and the second layer of material, wherein the first layer of material and the second layer of material are coupled with each other to form a longitudinally oriented section of the storage component such a central axis of the longitudinally oriented section of the storage component is substantially parallel with a central axis of each of the other longitudinally oriented sections of the other storage components from the plurality of storage components; and an opening through a surface the first layer of material to allow the one stake from the plurality of stakes to store between the first layer of material and the second layer of material.

2. The system of claim 1, wherein the one or more stakes are coupled with the ground cover utilizing one or more tethers.

3. The system of claim 2, wherein the one or more tethers include one or more elastic materials.

4. The system of claim 3, wherein the one or more elastic materials include one or more flat elastic bands.

5. The system of claim 1, wherein the first layer of material of each respective storage component includes at least one free edge, wherein the first layer of material and a portion of the ground cover form a pocket.

6. The system of claim 5, wherein each of the one or more stakes is stored in the pocket of a respective one of the one or more storage components.

7. The system of claim 5, wherein each pocket is configured to receive a weighting material separate from the one or more stakes.

8. The system of claim 1, wherein the second layer of material of each respective storage component includes at least one free edge, wherein the first layer of material, the second layer of material, and a portion of the ground cover form a pocket.

9. The system of claim 1, further comprise one or more catches configured to hinder the one or more stakes from slipping out from a respective storage component.

10. The system of claim 9, wherein the one or more catches include at least a a loop or a protrusion formed as part of one or more tethers coupled with one or more of the plurality of stakes.

11. The system of claim 9, wherein the one or more catches include a protrusion formed as part of each respective stake or attached with a respective stake.

12. The system of claim 9, wherein the one or more catches are positioned with respect to each respective stake such that each catch catches underneath a portion of the first layer of material of a respective storage component proximal to the opening through the first layer of material.

13. The system of claim 1, wherein one or more stakes include four stakes.

14. The system of claim 13, wherein each respective storage component is configured such that a central axis of each of the four stakes is substantially parallel with the central axes of the other stakes when the four stakes are stowed in respective storage components.

15. The system of claim 14, wherein each stake includes a flat material.

16. The system of claim 15, wherein each stake includes a metallic material.

17. A method comprising:

removing a plurality of stakes from a plurality of storage components, wherein the plurality of storage components are coupled with a ground cover such that each of the storage components from the plurality of storage compartments is configured to stow one stake from the plurality of stakes, wherein each of the storage components from the plurality of storage compartments includes:

a first layer of material coupled with the ground cover;

a second layer of material coupled with the ground cover such that the one stake from the plurality of stakes is stored between the first layer of material and the second layer of material, wherein the first layer of material and the second layer of material are coupled with each other to form a longitudinally oriented section of the storage component such a central axis of the longitudinally oriented section of the storage component is substantially parallel with a central axis of each of the other longitudinally oriented sections of the other storage components from the plurality of storage components; and an opening through a surface the first layer of material to allow the one stake from the plurality of stakes to store between the first layer of material and the second layer of material; and affixing the ground cover to a ground utilizing the plurality of stakes, wherein the plurality of stakes are coupled with the ground cover utilizing a plurality of tethers.

* * * * *